US005423608A

United States Patent [19]

Chyou et al.

[11] Patent Number: 5,423,608

[45] Date of Patent: Jun. 13, 1995

[54] MIXING APPARATUS WITH VORTEX GENERATING DEVICES

[75] Inventors: Yau-Pin Chyou, Taipei, Taiwan, Prov. of China; Adnan Eroglu, Untersiggenthal, Switzerland

[73] Assignee: ABB Management AG, Baden, Switzerland

[21] Appl. No.: 225,395

[22] Filed: Apr. 8, 1994

[30] Foreign Application Priority Data

Apr. 8, 1993 [CH] Switzerland ..... 01084/93

[51] Int. Cl.[6] ..... B01F 5/00

[52] U.S. Cl. ..... 366/337; 138/37

[58] Field of Search ..... 366/336–340; 48/189.4; 138/37–39, 114; 165/109.1

[56] References Cited

U.S. PATENT DOCUMENTS

| | | | |
|---|---|---|---|
| 1,022,493 | 4/1912 | Meigs | 138/37 |
| 1,454,196 | 5/1923 | Trood | 48/189.4 |
| 1,466,006 | 8/1923 | Trood | 48/189.4 |
| 3,051,452 | 8/1962 | Nobel | 366/337 |
| 3,404,869 | 10/1968 | Harder | 366/338 |
| 4,164,375 | 8/1979 | Allen | 366/337 |

FOREIGN PATENT DOCUMENTS

| | | | |
|---|---|---|---|
| 55-16696 | 5/1980 | Japan | 366/337 |

*Primary Examiner*—Charles E. Cooley

*Attorney, Agent, or Firm*—Burns, Doane, Swecker & Mathis

[57] ABSTRACT

A mixing apparatus for mixing two or more materials, includes a separating plate Upstream of a mixing zone having a plurality of vortex generators attached to the plate to create large scale longitudinal vortices in the materials as they pass the plate for rapid, controlled mixing in a short longitudinal distance. The vortex generators are arranged in a row transverse to the flow direction of the materials. The vortex generators each comprise three triangular-shaped surfaces joined to form a three sided wedge having a top surface and opposite sides surfaces that project into the flow path. The side surfaces are joined at an acute angle. The top surface is oriented at an angle to the plate. The angles may be adjusted for the type of materials to be mixed.

10 Claims, 1 Drawing Sheet

MIXING APPARATUS WITH VORTEX GENERATING DEVICES

BACKGROUND OF THE INVENTION

1. Field of the Invention

The invention relates to a mixing appliance for mixing two or more materials which can have equal or unequal mass flows, the materials to be mixed flowing along a separating plate arranged upstream of the mixing zone and means influencing the flow being applied to the separating plate.

2. Discussion of Background

In many industries, for example in chemistry, foodstuffs or pharmaceuticals production, it is a requirement that materials should be thoroughly mixed in the shortest possible distance. The quality of the complete process usually depends on the mixing quality achieved. The pressure drop during the mixing procedure should remain within "sensible" limits in order to keep the process costs low by keeping down the pumping work.

During the mixing of two free shear layers of flows with differing velocity, density or concentration at the end of a separating plate, two-dimensional (spanwise) vortices are generated in the absence of additional mixing elements. These are too slow for mixing purposes because the growth rate of a free shear layer is inadequate.

SUMMARY OF THE INVENTION

Accordingly, one object of the invention is to provide a novel mixing appliance, of the type mentioned at the beginning, by means of which large-scale longitudinal vortices can be generated which permit rapid, controlled mixing of the flowing materials within the shortest distance.

In accordance with the invention, this is achieved by an appliance, wherein the means are vortex generators of which a plurality are arranged adjacent to one another transverse to the flow direction over the width or the periphery of the separating plate, wherein a vortex generator has three surfaces around which flow can take place freely, which surfaces extend in the flow direction, one of them forming the top surface and the two others forming the side surfaces, wherein the side surfaces abut the same wall and form an acute angle $\alpha$ at a joining edge between them, wherein a top surface edge extending transverse to the wall around which flow occurs is in contact with the same wall as the side walls, and wherein the longitudinally directed edges of the top surface, which abut the longitudinally directed edges of the side surfaces protruding into the flow duct, extend at an angle of incidence $\Theta$ to the wall.

Using the new static mixer, which is represented by the three-dimensional vortex generators, it is possible to achieve extraordinarily short mixing distances in the mixing zone with simultaneously low pressure loss without having to change the overall configuration of the installation.

The advantage of such a vortex generator may be seen in its particular simplicity in every respect. From the point of view of manufacture, the element consisting of three walls around which flow occurs is completely unproblematic. The top surface can be joined to the two side surfaces in a wide variety of ways. Even the fixing of the element onto flat or curved duct walls can take place by means of simple welds in the case of weldable materials. From the point of view of fluid mechanics, the element has a very low pressure loss when flow takes place around it and it generates vortices without a dead water region. Finally, the element can be cooled in many different ways and with various means because of its generally hollow internal space.

It is useful to arrange the two side surfaces to meet at an acute angle $\alpha$ symmetrically about an axis of symmetry. Vortices with equal swirl are generated by this means.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
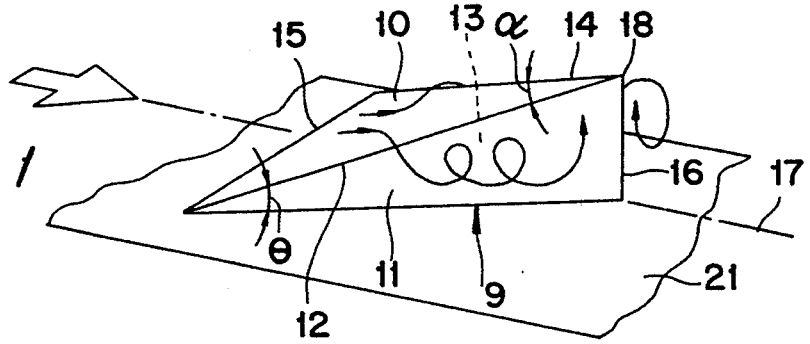
FIG. 1 shows a perspective representation of a vortex generator.
Figure 2:
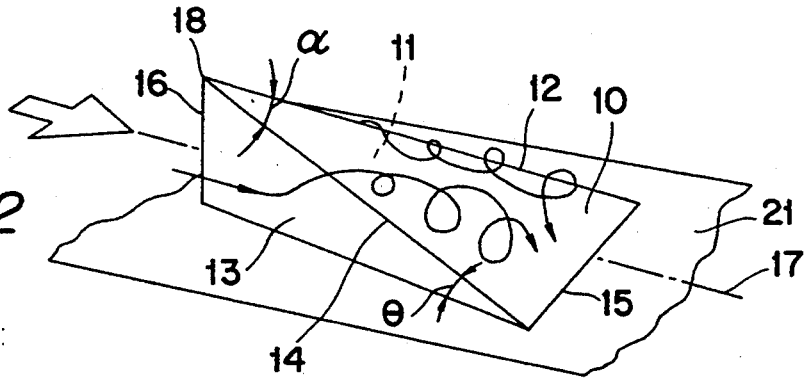
FIG. 2 shows an arrangement variant of the vortex generator.

Referring now to the drawings, wherein like reference numerals designate identical or corresponding parts throughout the several views, a vortex generator consists essentially of three joined triangular surfaces that project into a flow space so that around which flow can take place freely, as shown in FIGS. 1 and 2. These surfaces are a top surface 10 and two side surfaces 11 and 13. In their longitudinal extent, these surfaces extend at certain angles in the flow direction.

In the examples shown, the two side surfaces 11 and 13 are respectively at right angles to the associated wall 21 of a separating plate 22 but it should be noted that this is not imperative. The side walls, which consist of right-angled triangles, have their longitudinal sides fixed to this wall 21, preferably in a gastight manner. They are oriented in such a way that they form a joint at their narrow sides so as to include a acute angle $\alpha$. The joint is configured as a sharp connecting edge 16 and is also at right angles to that wall 21 which the side surfaces abut. When installed in a duct, the flow cross section is scarcely impaired by blockage due to the sharp connecting edge 16. The two side surfaces 11, 13 enclosing the acute angle $\alpha$ are symmetrical in shape, size and orientation and are arranged on both sides of an axis of symmetry 17. This axis of symmetry 17 extends in the same direction as the duct center line.

An edge 15 of the top surface 10 has a very flat configuration and extends transverse to the separating plate around which flow occurs. This edge is in contact with the same wall 21 as the side walls 11, 13. Its longitudinally directed edges 12, 14 abut the longitudinally directed edges of the side surfaces protruding into the flow duct. The top surface extends at an angle of incidence $\Theta$ relative to the wall 21. Its longitudinal edges 12, 14 form, together with the connecting edge 16, a point 18.

The vortex generator can also, of course, be provided with a bottom surface by means of which it is fastened to the wall 21 in a suitable manner. Such a bottom surface, however, has no relationship to the mode of operation of the element.

In FIG. 1, the connecting edge 16 of the two side surfaces 11, 13 forms the downstream edge of the vortex generator 9. The edge 15, of the top surface 10, extending transverse to the separating plate 22 around which flow occurs is therefore the edge which the duct flow meets first.

The mode of operation of the vortex generator is as follows. When flow occurs around the edges 12 and 14, the flow is converted into a pair of opposing vortices. The vortex axes are located in the axis of the flow. The geometry of the vortex generators is selected in such a way that no reverse flow zones occur during the generation of the vortices.

Figure 4:
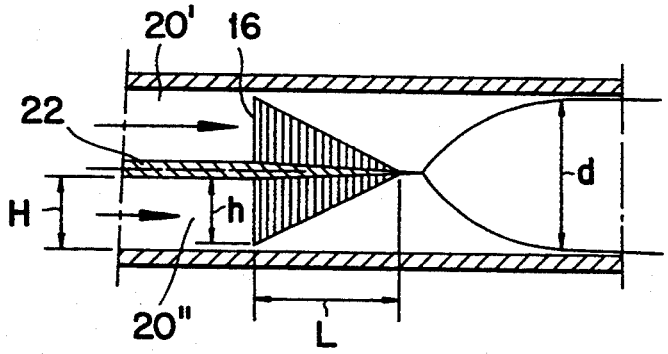
FIG. 4 shows a partial longitudinal section through the containment along the line 4—4 in FIG. 3.

The swirl number of the vortex is determined by appropriate selection of the angle of incidence $\Theta$ and/or the acute angle $\alpha$. With increasing angles, the vortex strength and the swirl number are increased and the location of the vortex breakdown—where this is at all desirable—moves upstream into the region of the vortex generator itself. These two angles $\Theta$ and $\alpha$ are specified, depending on the application, by design requirements and by the process itself. It is then only necessary to match the height h of the connecting edge 16 (FIG. 4).

In contrast to FIG. 1, the sharp connecting edge 16 in FIG. 2 is that position which the duct flow meets first. The element is rotated by 180° compared to FIG. 1. As may be recognized from the figures, the two opposing vortices have changed their direction of rotation. They rotate along above the top surface and move toward the wall on which the vortex generator is mounted.

Figure 3:
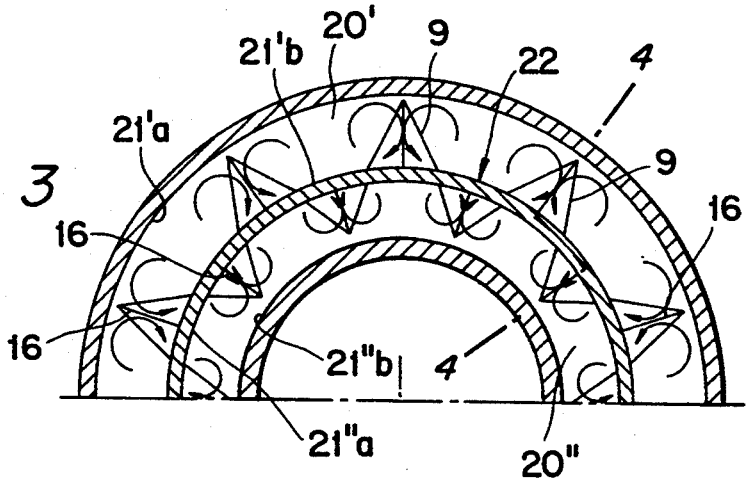
FIG. 3 shows a partial section through a containment with flow through twin ducts and with vortex generators installed.

It should be noted that the shape of the separating plate 22 around which flow occurs is not important to the mode of operation of the invention. Instead of the ring shape shown in FIG. 3, the separating plate 22 could also have a straight or hexagonal or some other cross-sectional shape. In the example of FIG. 3, the separating plate 22 is curved. In such a case, the above statement that the side surfaces are at right angles to the wall must, of course, be understood relatively. The essential point is that the connecting edge 16 located on the line of symmetry 17 is at right angles to the corresponding wall. In the case of ring-shaped walls, the connecting edge 16 would therefore be directed radially, as is shown in FIG. 3.

FIG. 3 shows, in part, a cylindrical containment with a separating plate 22 installed. The flow cross section is divided by this separating plate 22 into two coaxial, annular ducts 20′ and 20″ with the same duct height H. The outer wall of the separating plate forms the inner duct wall 21′*b* of the outer duct whereas the inner wall of the separating plate forms the outer duct wall 21″*a* of the inner duct. The two ducts could have the same medium flowing through them with different velocities or, alternately, flowing materials of different density or chemical composition, which have to be mixed to a certain evenly distributed concentration in the smallest distance, could be involved.

On each of these two duct walls 21′*b* and 21″*a*, the same number of vortex generators 9 is placed in a row in the peripheral direction with intermediate spaces. The height h of the elements 9 is approximately 90% of the duct height H. The annularly extending elements are provided in the same axial plane, as is shown in FIG. 4. In FIG. 3, the flow takes place at right angles into the plane of the drawing and the elements 9 are orientated in such a way that the connecting edges 16 are directed against the flow. It may be recognized that the direction of rotation of the vortices generated moves down in the region of the connecting edge, i.e. it moves toward that wall on which the vortex generator is arranged. At the end of the separating plate 22, the vortex flows generated on its two sides are forced into one another so that the desired intermixing occurs.

A further increase in the mixing quality is achieved if, as is shown in FIG. 3, the connecting edges 16 of the vortex generators in the two partial ducts are offset relative to one another by half a pitch. If equal-swirl vortices are assumed in the partial ducts, it may be recognized that the vortices, from the two sides of the separating plate and rotating about a common radial, combine to form a large vortex with a single direction of rotation.

From FIG. 4, in which the partial flow ducts are indicated by 20′ and 20″, it may be recognized (but this is not shown) that the vortex generators in the two partial ducts could have different heights relative to the duct height H. In general, the height h of the connecting edge 16 will be matched to the duct height H in such a way that the vortex generated has already reached such a size directly downstream of the vortex generator that the complete duct height H or the complete height of the duct part associated with the vortex generator is filled. This leads to an even distribution within the cross section which is acted upon. A further criterion which can have an influence on the ratio h/H to be selected is the pressure drop which occurs when flow takes place around the vortex generator. It is obvious that as the ratio of h/H increases, the pressure loss coefficient will also increase.

FIG. 4 likewise illustrates how the cross section of the mixing zone d increases steeply downstream of the trailing edge of the separating plate. In this configuration, it may be recognized that thorough mixing has already taken place after a short distance.

The invention is obviously not limited to the embodiments and application examples shown and described. For given flows, specific design and dimensioning of the vortex generators provides a simple means of controlling the mixing procedure to suit the requirement. As a departure from the arrangements shown in FIGS. 3 and 4—in which, of course, the outer duct walls 21′*a* and 21″*b* could also be omitted—it is possible to combine vortex generators in accordance with FIGS. 1 and 2 in order, for example, to increase the growth of the mixing zone d toward one side.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A mixing apparatus for mixing two or more flowing materials which can have equal or unequal mass flows, comprising:

a separating plate arranged in a flow duct upstream of a mixing zone; and a plurality of vortex generators attached to the plate and arranged adjacent to one another transverse to a flow direction;

wherein each vortex generator has three triangular surfaces projecting from the separating plate into the flow duct so that the materials flow around the surfaces, one of said surfaces forming a top surface and the two other surfaces forming side surfaces;

wherein the side surfaces have one edge attached to the separating plate and are joined at a connecting edge to form an acute angle therebetween;

wherein a top surface edge extending transverse to the flow direction is in contact with the separating plate;

and wherein longitudinal edges of the top surface projecting into the flow duct join longitudinal edges of the side surfaces projecting into the flow duct, the top surface arranged at a predetermined angle of incidence to the separating plate.

2. The mixing apparatus as claimed in claim 1, wherein in each vortex generator, the two side surfaces thereof are arranged symmetrically about an axis of symmetry parallel to the flow direction.

3. The mixing apparatus as claimed in claim 1, wherein for each vortex generator, the connecting edge of the side surfaces and the joined longitudinal edges of the top surface and side surfaces meet at a point, and wherein the connecting edge is at a right angle to the separating plate.

4. The mixing apparatus as claimed in claim 3, wherein for each vortex generator, at least one of the connecting edge and the joined longitudinal edges of the top surface and side surfaces are shaped to be at least approximately sharp.

5. The mixing apparatus as claimed in claim 3, wherein for each vortex generator, an axis of symmetry thereof is positioned parallel to the flow direction, the connecting edge of the two side surfaces is positioned as a downstream edge of each vortex generator and the top surface edge extending transverse to the flow direction is positioned as an upstream edge.

6. The mixing apparatus as claimed in claim 3, wherein for each vortex generator, an axis of symmetry thereof is positioned parallel to the flow direction, the connecting edge of the two side surfaces is positioned as an upstream edge and the top surface edge extending transverse to the flow direction is positioned as a downstream edge.

7. The mixing apparatus as claimed in claim 1, wherein the flow duct is a cylindrically shaped flow duct and the separating plate is arranged in said cylindrically shaped flow duct so as to form two annular partial ducts, and wherein the same number of vortex generators is arranged in a peripheral direction in each partial duct, and wherein the vortex generators are fastened on opposite sides of the separating plate with upstream edges of the vortex generators in a single plane.

8. The mixing apparatus as claimed in claim 7, wherein for each partial duct, a ratio of a height of the vortex generator to a height of the partial duct is selected so that a vortex generated fills a complete partial duct height associated with the vortex generators immediately downstream of the vortex generators.

9. The mixing apparatus as claimed in claim 8, wherein for each partial duct, the height of the vortex generators is approximately 90% of the height of the partial duct in which the vortex generators are mounted.

10. The mixing appliance as claimed in claim 7, wherein the vortex generators arranged on the opposite sides of the separating plate are offset relative to one another by half a pitch.

* * * * *